United States Patent [19]

Takahashi

[11] 4,441,438

[45] Apr. 10, 1984

[54] APPARATUS FOR MANUFACTURING A CONTINUOUS SLIDE FASTENER STRINGER CHAIN WITH ELEMENT-FREE SPACE PORTIONS

[75] Inventor: Kihei Takahashi, Uozu, Japan

[73] Assignee: Yoshida Kogyo K.K., Tokyo, Japan

[21] Appl. No.: 391,003

[22] Filed: Jun. 23, 1982

[30] Foreign Application Priority Data

Jun. 24, 1981 [JP] Japan ..... 56-93320[U]

[51] Int. Cl.[3] ..... D05C 3/12

[52] U.S. Cl. ..... 112/104; 112/113; 112/130; 112/121.27; 112/322

[58] Field of Search ..... 112/104, 113, 307, 322, 112/130, 121, 127, 315

[56] References Cited

U.S. PATENT DOCUMENTS

| | | | |
|---|---|---|---|
| 3,054,364 | 9/1962 | Popouitsch | 112/322 X |
| 3,381,639 | 5/1968 | Miller | 112/130 |
| 3,425,377 | 2/1969 | Scharmer | 112/322 |
| 3,987,533 | 10/1976 | Sandgren | 112/104 |
| 4,274,347 | 6/1981 | Rohrer | 112/322 |

FOREIGN PATENT DOCUMENTS

| | | | |
|---|---|---|---|
| 2302025 | 8/1973 | Fed. Rep. of Germany | 112/104 |

*Primary Examiner*—Ronald Feldbaum

*Attorney, Agent, or Firm*—Hill, Van Santen, Steadman & Simpson

[57] ABSTRACT

An apparatus for manufacturing a continuous slide fastener stringer chain including space portions devoid of coupling elements at longitudinal intervals. The apparatus comprises feed rollers for continuously feeding a pair of continuous stringer tapes, in synchronism with a sewing machine, to a sewing area in the sewing machine, a stationary guide member having a longitudinal channel for the passage of a pair of interengaged rows of coupling elements, and a toothed wheel projecting into the guide channel and rotatable for intermittently feeding the coupling elements in synchronism with the sewing machine to the sewing area. A cutter assembly is disposed between the sewing area and the toothed wheel for cutting off a length of coupling elements then being sewn from the interengaged rows of continuous coupling elements each time the latter stops moving.

5 Claims, 9 Drawing Figures

APPARATUS FOR MANUFACTURING A CONTINUOUS SLIDE FASTENER STRINGER CHAIN WITH ELEMENT-FREE SPACE PORTIONS

BACKGROUND OF THE INVENTION

1. Field of the Invention

The present invention relates generally to the production of slide fasteners, and more particularly to an apparatus for manufacturing a continuous slide fastener stringer chain including space portions devoid of coupling elements at longitudinal intervals.

2. Prior Art

According to a known practice, a continuous slide fastener stringer chain having a pair of interengaged rows of continuous coupling elements sewn to a pair of continuous slide fastener stringer tapes along inner longitudinal edges, respectively, is intermittently fed in a longitudinal direction, and while the stringer chain is at rest, segments of coupling elements are cut off and removed to provide element-free space portions in the stringer chain at longitudinal intervals. With the known method, it has been observed that lines of stitching become slack at portions extending longitudinally across the element-free space portions with the result that endmost coupling elements, located next to the element-free space portions, are liable to be displaced. Such positionally unstable, endmost coupling elements hinder sliders from sliding thereover.

In another known practice, a row of continuous coupling elements is intermittently supplied over one longitudinal edge of a continuous slide fastener stringer tape which is continuously fed to the sewing area of a sewing machine. The row of continuous coupling elements, while at rest, is severed into pieces of coupling elements to thereby produce element-free space portions between every adjacent pair of the pieces of coupling elements. Then the stringer tape is paired with a companion stringer tape into a continuous slide fastener stringer chain. The rows of coupling elements of severed length tend to be deformed or irregular in pitch under the influence of forces exerted thereon while they are fed before being coupled together, resulting in mismeshing of the coupling elements, particularly those coupling elements which are located next to the element-free space portions.

SUMMARY OF THE INVENTION

It is an object of the present invention is to provide an apparatus which can manufacture a continuous slide fastener stringer chain including space portions devoid of coupling elements, substantially at a single working station.

Another object of the present invention is to provide an apparatus for manufacturing a continuous slide fastener stringer chain including space portions devoid of coupling elements at longitudinal intervals, in which endmost coupling elements adjacent to the space portions are fixed in position for allowing sliders to slide smoothly thereover.

Another object of the present invention is to provide an apparatus for manufacturing a continuous slide fastener stringer chain, in which a pair of interengaged rows of coupling elements is sewn to a pair of continuous slide fastener stringers along inner longitudinal edges, respectively, with uniform coupling element pitch.

Another object of the present invention is to provide an apparatus including means for positioning a pair of interengaged rows of coupling elements in a predetermined cutting position, thereby manufacturing a continuous slide fastener stringer chain having alternate element-containing and element-free portions of uniform length.

According to the present invention, an apparatus comprises a sewing machine drivable to sew a pair of interengaged rows of continuous coupling elements to a pair of continuous slide fastener stringer tapes along inner longitudinal edges, respectively, means for continuously feeding the pair of continuous slide fastener stringer tapes, in synchronism with said sewing machine, to a sewing area of the sewing machine, and a stationary guide member having a longitudinal guide channel for the passage therethrough of the pair of interengaged rows of coupling elements. A wheel has on its periphery means projecting into the guide channel for engaging and feeding the pair of interengaged rows of coupling elements, the wheel being rotatable to intermittently feed the pair of interengaged rows of coupling elements, in synchronism with the sewing machine, to the sewing area. A cutter assembly is disposed between the sewing area and the wheel for cutting off a length of coupling elements then being sewn from the pair of rows of coupling elements each time the wheel stops rotation to suspend the movement of the interengaged rows of coupling elements. The cutter assembly comprises a stationary die having a guide groove extending in alignment with the guide channel and a die surface extending transversely across said guide groove, and a movable cutter slidably movable along the die surface across the guide groove. The apparatus further includes means responsive to coaction with the movable cutter for positioning the pair of interengaged rows of coupling elements in a predetermined cutting position.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
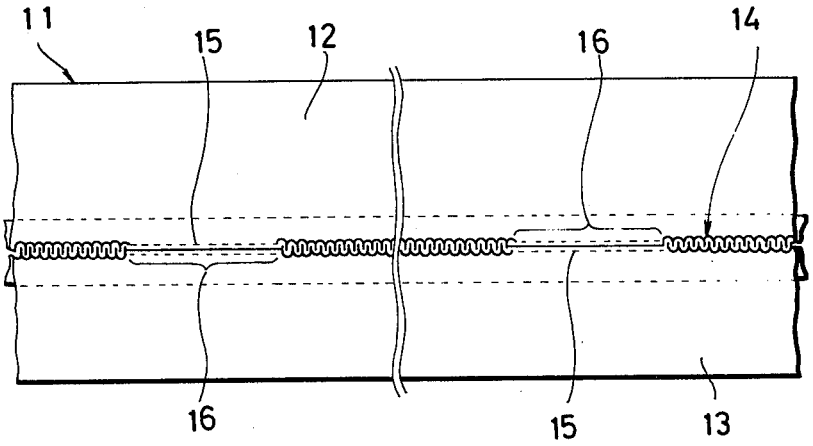
FIG. 1 is a fragmentary plan view of a continuous slide fastener stringer chain made by the present invention.
Figure 2:
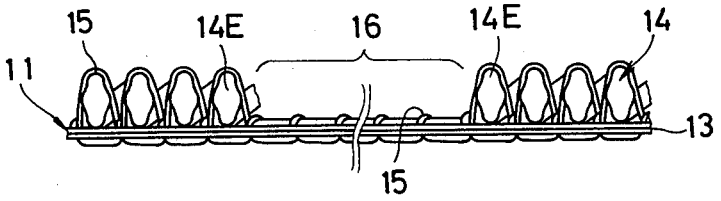
FIG. 2 is an enlarged front elevational view of a portion of the slide fastener stringer chain shown in FIG. 1.

As shown in FIGS. 1 and 2, a continuous slide fastener stringer chain 11 comprises a pair of continuous slide fastener stringer tapes 12,13 and a series of longitudinally spaced pairs of interengaged rows of coupling elements 14 of individual lengths of slide fasteners secured to the stringer tapes 12,13 on and along respective doubled, inner longitudinal edges as by a pair of lines of stitching 15,15, there being space portions 16 devoid of coupling elements in the slide fastener stringer chain 10 at longitudinal intervals. As clearly shown in FIG. 2, the line of stitching 15 tightly stitches the stringer tape 13 longitudinally across the space portions 16 (only one shown). With this arrangement, even endmost coupling elements 14E (FIG. 2) adjacent to the space portion 16 are fixed in position and remain in substantially the same shape and pitch as the other continuous coupling elements 14, allowing a slider (not shown) to slide smoothly over the endmost coupling elements 14E.

Figure 3:
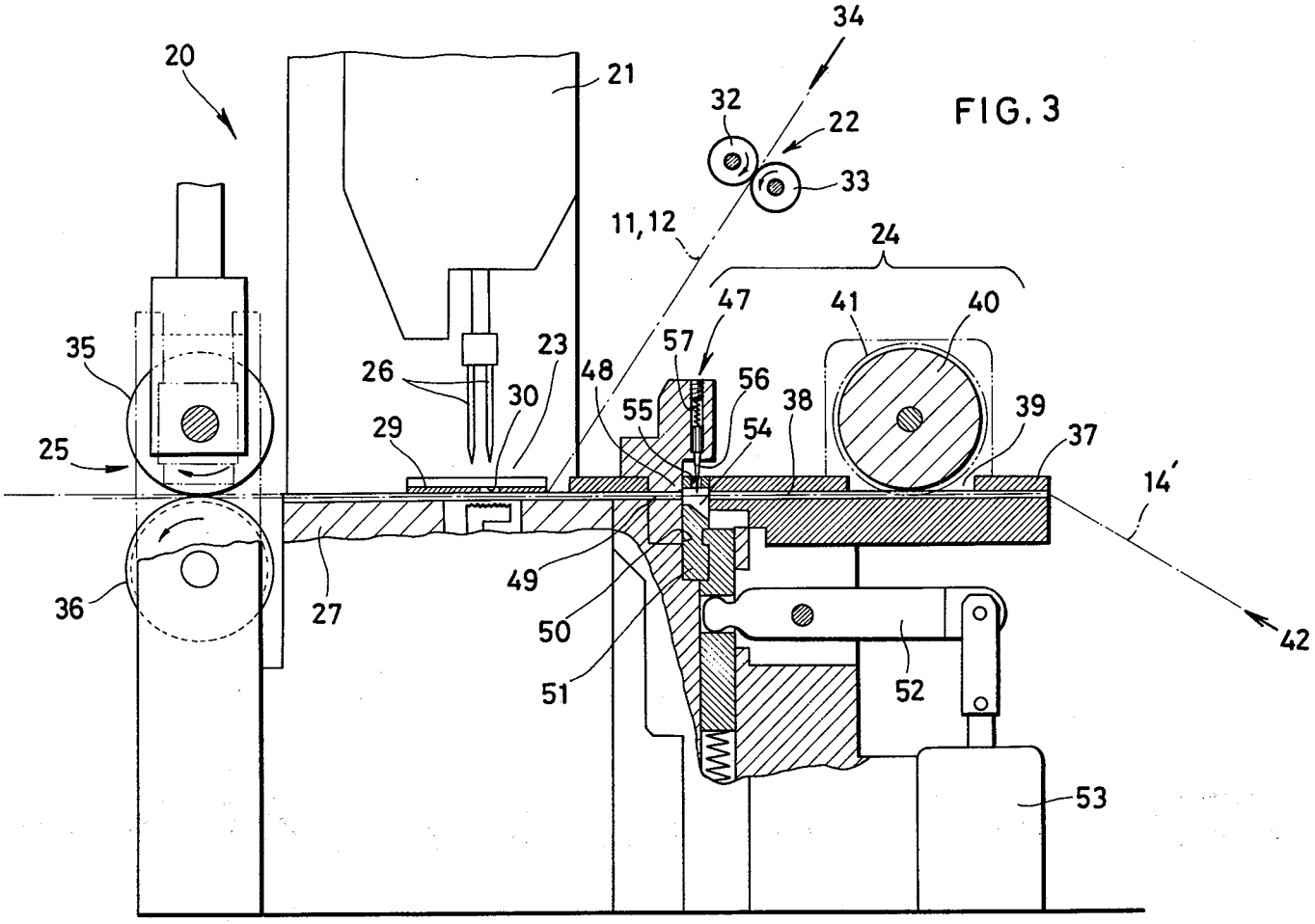
FIG. 3 is a fragmentary front elevational view, partly in cross section, of an apparatus according to the present invention.
Figure 4:
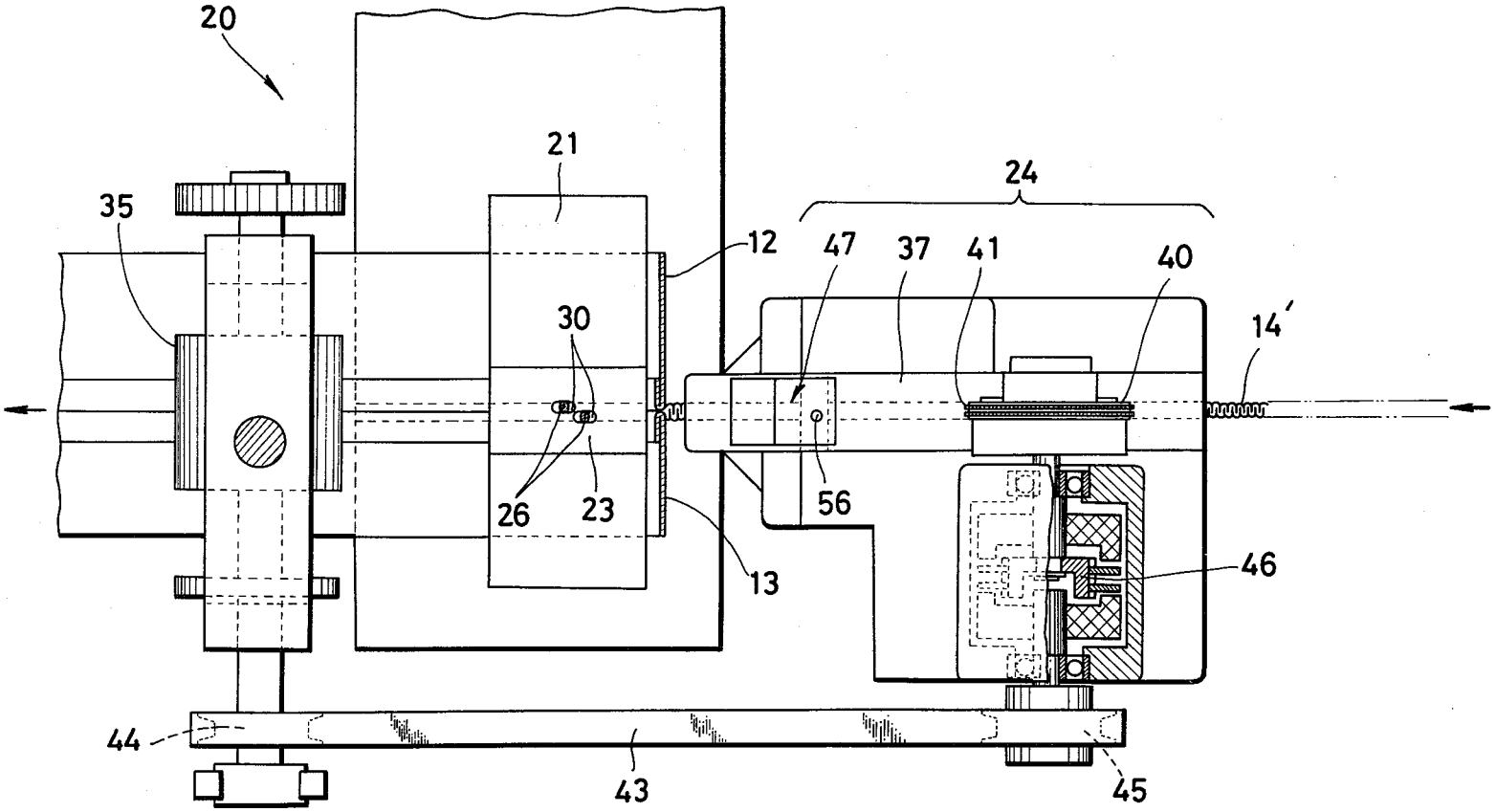
FIG. 4 is a fragmentary plan view, partly in cross section, of the apparatus shown in FIG. 3, the apparatus being partly omitted for clarity.

As shown in FIGS. 3 and 4, an apparatus 20 for manufacturing the slide fastener stringer chain 11 generally comprises a sewing machine or mechanism 21, a feed means 22 for continuously feeding the pair of continuous slide fastener stringer tapes 12,13 to a sewing area or station 23, a combined feeding and cutting unit 24 for intermittently feeding a pair of interengaged rows of continuous coupling elements 14' to the sewing area 23, and for cutting off a length of coupling elements 14 from the continuous coupling elements 14', and a withdrawal means 25 for withdrawing the stringer tapes 12,13 from the sewing area 22.

Figure 9:
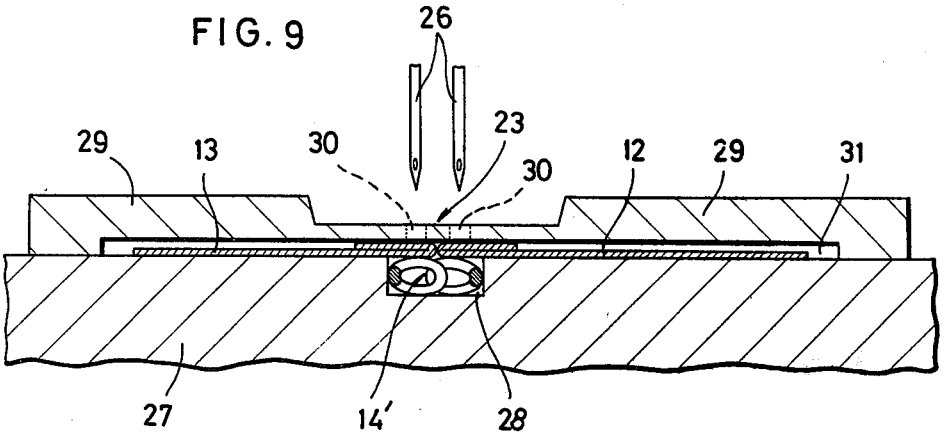
FIG. 9 is an enlarged, fragmentary transverse cross-sectionalview of a sewing station of a sewing machine of the apparatus shown in FIG. 3.

The sewing machine 21 is a conventional two needle sewing machine and comprises a pair of needles 26,26 adapted to be driven to sew the interengaged rows of coupling elements 14 to the stringer tapes 12,13 along inner longitudinal edges, respectively. The sewing machine 21 includes a table 27 having a guide groove 28 (FIG. 9) extending longitudinally therethrough across the sewing area 23 for the passage therethrough of the coupling elements 14, and a guide plate 29 mounted on the table 27 and having a pair of needle holes 30,30 for the passage therethrough of the respective needles 26,26. The guide plate 29 further has a recess 31 (FIG. 9) for the passage therethrough of the stringer tapes 12,13.

The stringer tape feeding means 22 comprises a cooperating pair of drive and driven rollers 32,33 disposed upstream of the sewing machine 21. The drive roller 32 is rotatable in synchronism with the sewing machine 21 so as to continuously feed the stringer tapes 12,13 to the sewing area 23 of the sewing machine 21 along a first longitudinal path 34, the path 34 being inclined with respect to the plane of the table 27.

The stringer tape withdrawal means 25 comprises an adjustable drive roller 35 held in driving contact with a fixed, driven roller 36, the rollers 35,36 being disposed downstream of the sewing machine 21. The drive roller 35 is driven by a suitable driving means (not shown) to rotate in synchronism with the sewing machine 21 for continuously withdrawing the stringer tapes 12,13 from the sewing area 23 of the sewing machine 21.

The combined intermittently feeding and cutting unit 24 comprises a stationary guide member 37 disposed upstream of the sewing machine 21 and having a guide channel 38 extending in alignment with the guide groove 28 (FIG. 9) in the table 27 of the sewing machine 21, for the passage therethrough of the interengaged rows of coupling elements 14'. The guide member 37 has a slot 39 opening to the guide channel 38 for the purpose described below. A fixed axis, rotatable toothed member or wheel 40 is disposed above the guide member 37 adjacent to the slot 39 thereof. The wheel 40 has a pair of rows of teeth or projections 41 arranged around the periphery thereof at equal intervals, a number of which project through the slot 38 into the guide channel 39 for engaging and feeding the interengaged coupling elements 14' along a second longitudinal path 42. As shown in FIG. 4, the toothed wheel 40 is driven in synchronism with the drive roller 35 of the withdrawal means 25 by means of a belt 43 which is trained around a pair of pulleys 44,45. The pulley 44 is connected to a drive shaft of the roller 35, and the pulley 45 is connected via a clutch means 46 to a shaft of the wheel 40 for intermittently feeding the interengaged rows of coupling elements 14' upon energization and de-energization of the clutch means 46.

The combined feeding and cutting unit 24 further includes a cutter assembly 47 disposed between the sewing machine 21 and the wheel 40. The cutter assembly 47 comprises a statioanry die 48 having a guide groove 49 extending in alignment with the guide channel 38 in the guide member 37 for the passage therethrough of the rows of coupling elements 14', and a die surface 50 extending transversely across the guide channel 49. A movable cutter 51 is supported on one end of a pivot lever 52 connected at the other end to a solenoid 53 for pivotal movement. The movable cutter 51 is vertically movable along the die surface 50 across the guide groove 49 in response to the pivotal movement of the pivot lever 52. The movable cutter 51 has a horizontal guide slot 54 normally held in alignment with the guide groove 49 and the guide channel 38, and a vertical hole 55 opening to the guide slot 54 for the purpose described below. The stationary die 48 has a vertical hole 57 in alignment with the vertical hole 55 in the movable cutter 51. A pin 56 is resiliently received in the hole 57 and is normally held in a position shown in FIG. 3 where the tip of the pin 56 projects through the hole 55 into the guide slot 54 and is located close to the rows of coupling elements 14' in the guide slot 54. The pin 56 has a diameter projectable into any adjacent pair of coupling elements of one of the two rows of coupling elements 14'.

In operation, the slide fastener stringer tapes 12,13 are introduced the recess 31 in the sewing area 23 of the sewing machine 21 along the path 34, and the interengaged rows of coupling elements 14' are also introduced into the groove 28 in the sewing area 23 along the path 42 through the guide channel 38, through the guide slot 54 and through the guide groove 49. In the sewing area 23, the rows of coupling elements 14' and the stringer tapes 12,13 are set in a position of FIG. 9 where the coupling elements 14' are held on doubled, inner longitudinal edges of the tapes.

Figure 5:
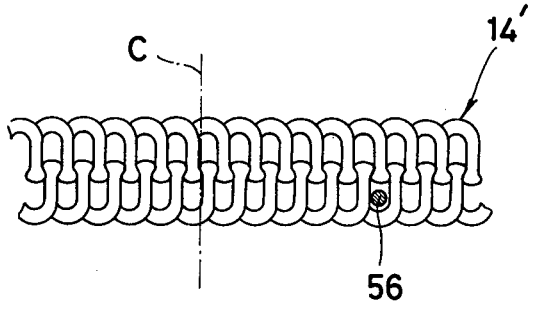
FIG. 5 is an enlarged fragmentary plan view of the interengaged rows of coupling elements as being positioned in a cutting position.
Figure 6:
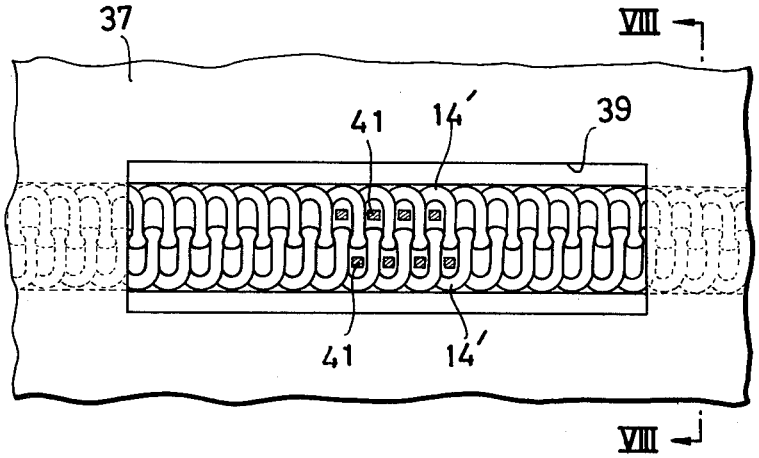
FIG. 6 is an enlarged fragmentary plan view of a coupling element feeding unit of the apparatus shown in FIG. 3, a toothed wheel of the feeding unit being omitted for clarity except showing several teeth thereof.
Figure 7:
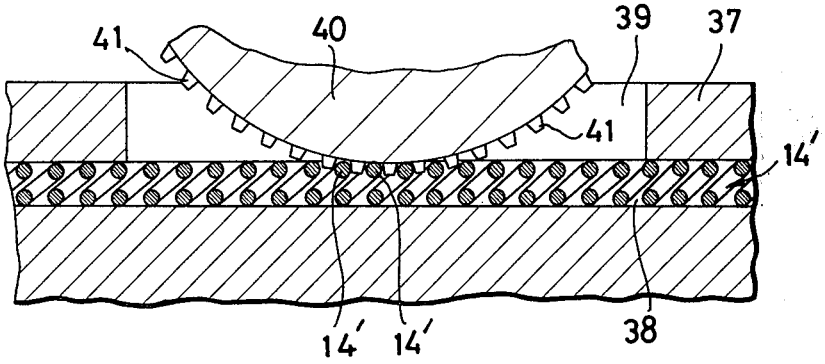
FIG. 7 is a longitudinal cross-sectional view of the feeding unit shown in FIG. 6, a peripheral portion of the toothed wheel being shown.
Figure 8:
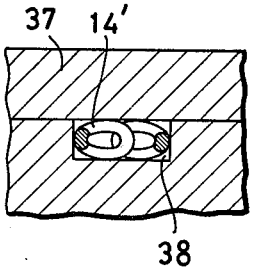
FIG. 8 is a fragmentary transverse cross-sectional view taken along the line VIII—VIII of FIG. 6.

Then the sewing machine 21 is driven to continuously sew the rows of coupling elements 14' to the stringer tapes 12,13 along respective longitudinal edges at a predetermined speed of sewing. Simultaneously therewith, the drive rollers 32,35 and the toothed wheel 40 are driven to rotate in the clockwise direction in FIG. 3 in synchronism with the sewing machine 21 so that the coupling elements 14' and the stringer tapes 12,13 are fed to the sewing area 23 at the same speed as the speed of the sewing, and the stringer tapes 12,13 with the coupling elements 14' sewn thereto are withdrawn from the sewing area 23 at the same speed as the speed of sewing. When a predeterminded length of coupling elements 14' has been fed to the sewing area 23, the clutch 46 is energized to disengage the toothed wheel 40 from driven engagement with the pulley 45, stopping the feed of the coupling elements 14, the pulley 45 being continuously driven to rotate in synchronism with the drive roller 35. At the same time, the solenoid 53 is energized to actuate the pivot lever 52 to rotate in clockwise direction, causing the movable cutter 51 to slidably move upwardly along the die surface 50 across the rows of coupling elements 14' in the guide slot 54. Thus, a length of coupling elements 14 then being sewn is cut off from the interengaged rows of continuous coupling elements 14'. During that time, as the rows of coupling elements 14' are moved upwardly by the movable cutter 51, the pin 56 projects into a space between two adjacent coupling elements 14' of one row of coupling elements to thereby position the rows of coupling elements in a predetermined position where a cutting line C (FIG. 5) defined by the die surface 50 extends transversely across the rows of coupling elements between the coupling heads of an interengaged pair of coupling elements. With continued sewing of the sewing machine 21, the length of coupling elements 14 is introduced into the sewing area 23 and sewn to the stringer tapes 12,13 which are continuously fed to the sewing area 23 by the tape feed means 22. Upon the elapse of a predetermined interval of time, the clutch 46 is de-energized to engage the pulley 45 into driving relation with the toothed wheel 40 for feeding the rows of coupling elements 14' in synchronism with the withdrawal means 25 and the sewing machine 21. At the same time, the solenoid 53 is de-energized to bring the movable cutter 51 to the position shown in FIG. 3. The foregoing cycle of operation is repeated to thereby produce the continuous slide fastener stringer chain 11 with element-free space portions 16 at longitudinal intervals, shown in FIGS. 1 and 2.

With the apparatus of the present invention, the rows of coupling elements 14' fed and cut in interengaged fashion are resistant to deformation and remain in uniform element pitch, and the endmost coupling elements 14E adjacent element-free space portions 16 are fixed in position by the lines of stitching extending tightly over the coupling element rows 14 longitudinally across the space portions 16 with the result that the sliders can be mounted smoothly on the rows of coupling elements 14 over the endmost coupling elements 14E. With the provision of the pin 56, the continuous slide fastener chain 11 has alternate element-containing and element-free portions of uniform length.

Although various minor modifications may be suggested by those versed in the art, it should be understood that I wish to embody within the scope of the patent warranted hereon, all such emboidments as reasonably and properly come within the scope of my contribution to the art.

What is claimed is:

1. An apparatus for manufacturing a continuous slide fastener stringer chain including space portions devoid of coupling elements at longitudinal intervals, the apparatus comprising:

(a) a sewing machine continuously drivable to sew a pair of interengaged rows of continuous coupling elements to a pair of continuous slide fastener stringer tapes along inner longitudinal edges, respectively;

(b) means for continuously feeding said pair of continuous slide fastener stringer tapes, in synchronism with said sewing machine, to a sewing area of said sewing machine along a first longitudinal path;

(c) a stationary guide member having a longitudinal guide channel for the passage therethrough of said pair of interengaged rows of coupling elements;

(d) a wheel having on its periphery means projecting into said guide channel for engaging and feeding said pair of interengaged rows of coupling elements, said wheel being rotatable to intermittently feed said pair of interengaged rows of coupling elements, in synchronism with said sewing machine, to said sewing area along a second longitudinal path; and (e) a cutter assembly disposed between said sewing area and said wheel for cutting off a length of coupling elements then being sewn from said pair of rows of coupling elements each time the latter stops moving.

2. An apparatus according to claim 1, said cutter assembly comprising a stationary die having a guide groove extending in alignment with said guide channel and a die surface extending transversely across said guide groove, and a movable cutter slidably movable along said die surface across said guide groove.

3. An apparatus according to claim 2, including means responsive to and coactive with said movable cutter for positioning said pair of interengaged rows of coupling elements in a predetermined cutting position.

4. An apparatus according to claim 3, said positioning means comprising a pin having a tip movally held in a position close to said pair of interengaged rows of coupling elements and receivable into a space between two adjacent coupling elements of one of said rows of coupling elements as said movable cutter is moved across said guide groove.

5. An apparatus according to claim 1, including means for rotating said wheel, and clutch means for bringing said wheel into and out of driven engagement with said rotating means.

* * * * *